United States Patent [19]

Blodgett et al.

[11] 4,132,886

[45] Jan. 2, 1979

[54] HEATING ELEMENT

[75] Inventors: Gary C. Blodgett, Boylston, Mass.; George H. Powers, Arlington Heights, Ill.

[73] Assignee: Norton Company, Worcester, Mass.

[21] Appl. No.: 842,115

[22] Filed: Oct. 14, 1977

[51] Int. Cl.[2] ..... H05B 3/10

[52] U.S. Cl. ..... 219/523; 13/25; 219/335; 219/553; 338/333

[58] Field of Search ..... 219/331, 335, 523, 536, 219/552, 553, 534; 13/20, 22, 23, 25; 338/237, 272, 326, 333; 427/122

[56] References Cited

U.S. PATENT DOCUMENTS

| | | | |
|---|---|---|---|
| 2,725,032 | 11/1955 | Mann | 13/25 X |
| 3,012,374 | 12/1961 | Merker | 13/25 X |
| 3,137,590 | 6/1964 | Coes | 427/122 |
| 3,237,144 | 2/1966 | Joeckel | 219/553 X |
| 3,269,806 | 8/1966 | Fitzer et al. | 338/333 |
| 3,518,351 | 6/1970 | Ohnsorg et al. | 13/20 X |
| 3,611,559 | 10/1971 | McKay et al. | 219/523 X |
| 3,731,058 | 5/1973 | Bleiweiss | 219/523 |
| 3,835,296 | 9/1974 | Middough et al. | 219/553 |

FOREIGN PATENT DOCUMENTS

| | | | |
|---|---|---|---|
| 1056297 | 4/1959 | Fed. Rep. of Germany | 13/25 |

*Primary Examiner*—Volodymyr Y. Mayewsky
*Attorney, Agent, or Firm*—Oliver W. Hayes

[57] ABSTRACT

The heating element is made of a plurality of silicon carbide rods, at least four rods being employed in the heating element. The hot ends of all the rods are connected together by a single silicon carbide bridge member. The other (cold) ends of the rods are arranged so that at the current input side two rods are in parallel and on the output side the other two rods are also in parallel and the two pairs of electrically parallel rods are connected in series electrically at the silicon carbide bridge member. The rods are preferably arranged in a square configuration and preferably extend perpendicular to the bridge member. Accordingly the rods can be inserted in a silicon carbide tube closed at the hot end. The interior heating rods are electrically insulated from the silicon carbide tube.

3 Claims, 2 Drawing Figures

HEATING ELEMENT

BACKGROUND OF THE INVENTION

Silicon carbide heating elements have been used for many years for various industrial heating applications. In such applications where it is desired that the heating element be below the surface of a molten metal, for example such as in a molten aluminum casting furnace resevoir, it is desirable to enclose the heating element in an outer tube from which the heating element is electrically insulated. When single heating elements are utilized in a tube it is difficult to get the amount of power generated from each heating element which is desired for an efficient and economical construction.

In the present invention the heating element is formed of a plurality of silicon carbide rods, four being the minimum needed for making an immersion type heater. Each silicon carbide rod has a hot end and a cold end. The heating element is also supplied with an input electrical terminal and an output electrical terminal. At least two rods are connected to each output terminal at their cold ends. The hot ends of all of the rods are connected together by a silicon carbide bridge element. As a result of this arrangement each electrical heating circuit includes at least two input rods in parallel and two output rods in parallel, with the input rods in series with the output rods. With this arrangement the input and output electrical terminals are positioned adjacent each other and the heating element is in the form of a U-shape to provide a concentrated heat source which can be inserted inside a closed end silicon carbide tube to make an efficient emmersion heater having a high unit KW output.

THE PRIOR ART

The closest prior art is German patent 1,056,297 showing a silicon carbide heating element is a U-shaped having three silicon carbide rods whose hot ends are connected to a silicon carbide bridge member (see FIGS. 4 and 5). This is a 3-phase star connected system. There are similar disclosures in the U.S. Pat. No. 3,518,351 (see FIGS. 1 and 2) and U.S. Pat. No. 3,835,296 (see FIG. 15). None of these prior art devices however, have the advantage that the input and output leads are connected so that the two heating rods on the input and output sides are in parallel so that if one of the two parallel heating rods should crack or otherwise develop a high resistance spot the heating element can continue to operate, the current will then be largely carried by the other parallel heating rod.

DETAILED DESCRIPTION OF THE INVENTION

Figure 2:
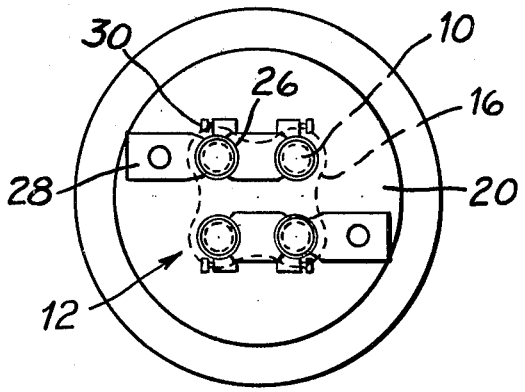
Figure 1:
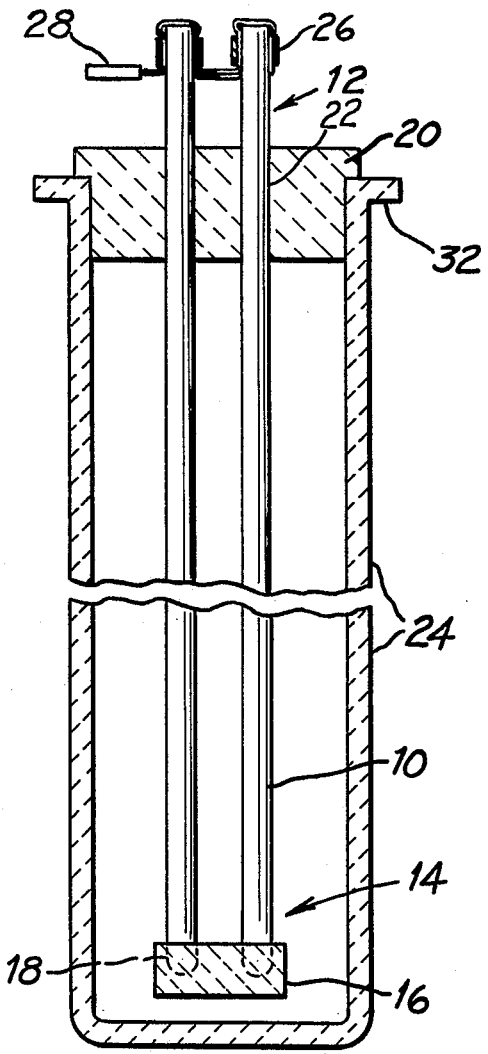

In order to more fully understand the invention, reference should be had to the following schematic diagramatic drawings showing one preferred form of the invention. In this drawing FIG. 1 is a side view and FIG. 2 is a plan view. There are four individual silicon carbide heating rods 10 each of which have a "cold" end 12 and a "hot" end 14. The rods 10 preferably are formed by the techniques described in U.S. Pat. No. 3,137,590 to Coes and assigned to the assignee of the present application. In the Coes patent a construction of the silicon carbide heating rods is described wherein both ends are treated to make them "cold". Obviously, in the present invention only one end of the bar would be treated so as to give it a "cold" end. A Bridge member is illustrated as a planar silicon carbide piece 16 having four holes 18 into which the "hot" ends of the silicon carbide heater rods are inserted. A firm electrical and structural contact between the heater rods and the bridge member is preferably achieved by using the cementing technique which is describe in German Pat. No. 1,056,297, wherein a mixture of finely divided silicon carbide and tar is placed between the surface of each rod and the surface of each bridge member hole. The assembled structure is then fired at an elevated temperature in a silicon atmosphere to convert the tar to carbon and then to silicon carbide cement, the rods to the bridge member and form a firm mechanical and electrical bond between the hot end 14 of the heater rods and the bridge member 16.

The silicon carbide rods 10 are supported in a refractory support block 20, rods 10 passing holes 22 in the support block. This serves to separate the rods at their cold ends and to physically support them so that they can be suspended within a high temperature closed end refractory tube 24. At the cold ends of the rods there are provided two electrical connections 26 having input and output terminals 28 which lead to separate sides of the power source. As shown in FIGS. 1 and 2 two rods are connected together at their cold ends to one electrical terminal and the other two rods are connected together at their cold ends to the other electrical terminal. Suitable clamp means, such as schematically indicated at 30, are provided for making firm electrical contact between the contacts 26 and the cold ends of the rods.

With the preferred arrangement shown the whole high temperature closed end tube 24 can be suspended in the body of a furnace by means such as the lip 32 so that the hot portions of the silicon carbide heating rods are stationed at the desired location in the furnace but the electrical connections to the rods may be positioned outside of the furnace. By this arrangement a highly concentrated source of heat is provided, which may be protected from the ambient atmosphere in the furnace, and the electrical connections may be positioned completely outside the furnace. If one of the rods should develop a crack, or a high resistance point, most of the current will be carried by the other rod in parallel with the defective rod and the heating element will continue to operate, although at somewhat lower total power output.

This arrangement as heating rods and refractory tube is also particularly advantageous when the heating element is to be used as an immersion heater for maintaining a supply of molten metal, for example, at a proper elevated temperature. In this case the closed end tube 24 can be immersed in the molten metal up to the tip 22 and the electrical leads will remain above the level of the metal.

When the immersion heating element is to be used to maintain a supply of aluminum at a temperature above its melting point (660° C.) the closed end tube 24 is preferably formed from recrystallized silicon carbide in accordance with the teachings of U.S. Pat. No. 2,964,823.

What is claimed is:

1. A heating element comprising a plurality of silicon carbide heating rods, each rod having a hot end and a cold end, an electrical input terminal and an electrical output terminal, at least two rods connected to each input terminal at their cold ends, at least two rods connected to each output terminal at their cold ends, the hot ends of all said rods being connected together by a silicon carbide bridge element whereby each heating circuit includes at least two input rods in parallel and two output rods in parallel with the input rods in series with the output rods.

2. An immersion heating element comprising a plurality of silicon carbide heating rods, each rod having a hot end and a cold end, an electrical input terminal and an electrical output terminal, at least two rods connected to each input terminal at their cold ends, at least two rods connected to each output terminal at their cold ends, the hot ends of all said rods being connected together by a silicon carbide bridge element whereby each heating circuit includes at least two input rods in parallel and two output rods in parallel with the input rods in series with the output rods, a refractory tube having a closed end surrounding said plurality of heating rods, the rods being held by an insulating refractory block adjacent the cold ends of the rods, which block is supported by the end of the tube opposite the closed end, the hot ends of the rods being adjacent the closed end, said tube being impervious to the fluid into which the heater is to be immersed.

3. The heating element of claim 1 wherein the silicon carbide bridge element is planar and has holes into which the rods are cemented by silicon carbide cement, all the rods extending from, and being approximately normal to, one surface of the bridge element, the rods being approximately equally spaced from the center of the bridge element.

* * * * *